US005123656A

United States Patent [19]

Green

[11] Patent Number: 5,123,656

[45] Date of Patent: Jun. 23, 1992

[54] APPARATUS AND METHOD FOR PLAYING A GAME OF TOSS

[76] Inventor: James E. Green, 640 Robertsville Rd., Oak Ridge, Tenn. 37830

[21] Appl. No.: 662,937

[22] Filed: Mar. 1, 1991

[51] Int. Cl.[5] ..... A63B 67/00

[52] U.S. Cl. ..... 273/400; 273/415

[58] Field of Search ..... 273/400, 401, 402, 415, 273/336, 338

[56] References Cited

U.S. PATENT DOCUMENTS

| | | | |
|---|---|---|---|
| 715,249 | 12/1902 | Dunbar | 273/415 X |
| 979,109 | 12/1919 | Underhill | 273/400 |
| 1,114,523 | 10/1914 | Revell | 273/398 X |
| 1,442,054 | 1/1923 | Dixon | 273/400 X |
| 2,126,245 | 8/1938 | Darby | 273/400 X |
| 3,244,420 | 4/1966 | Poynter | 273/402 |
| 3,790,174 | 2/1974 | Skillern . | |
| 3,924,856 | 12/1975 | Dekan et al. . | |
| 4,186,925 | 2/1980 | Goldfarb et al. | 273/389 |
| 4,204,682 | 5/1980 | Brown | 273/401 |
| 4,335,881 | 6/1982 | Warehime | 273/348 |
| 4,354,679 | 10/1982 | Steinmetz | 273/415 X |
| 4,392,653 | 7/1983 | Blume, Sr. | 273/400 |
| 4,726,591 | 2/1988 | Johnson | 273/402 X |
| 4,877,256 | 10/1989 | Falloon | 273/400 |
| 4,938,485 | 7/1990 | Hockridge et al. | 273/401 |
| 4,943,065 | 7/1990 | DeLapa | 273/402 |
| 5,018,745 | 5/1991 | Dunse | 273/400 X |
| 5,040,801 | 8/1991 | Weymuth | 273/400 X |
| 5,052,693 | 10/1991 | Hicks | 273/400 X |

FOREIGN PATENT DOCUMENTS 19699 of 1897 United Kingdom ..... 273/400

*Primary Examiner*—William H. Grieb

*Attorney, Agent, or Firm*—Pitts and Brittian

[57] ABSTRACT

An apparatus for playing a game of toss (10). The game may be played by people of all ages and physical abilities, and may be played from a sitting or standing position. The game (10) is adaptable for indoor and outdoor play. The apparatus for a game of toss (10) includes a plurality of tossing objects (14) such as bean bags or balls for tossing toward a target receptacle (12). A target receptacle (12) includes at least an inner and an outer vertical receptacle (18–28) with side walls (16–26) such that volumes (18–28) are defined within the inner wall (16) and between the inner wall (16) and the outer wall (26), respectively. In the preferred embodiment, the outer wall (26) includes a forward portion (36) with a depending section (38) proximate the top (32) such that a larger opening for the passage of the tossing object (14) is provided. The inner and outer walls (16–26) are attached to a base (44) such that the walls (16–26) do not move in relation to one another during play. The target receptacle (12) of the preferred embodiment may be easily disassembled for transport and storage. Scoring is determined by the number of tossing objects (14) landing within the separate volumes (18–28), with a greater number of points awarded for a tossing object (14) landing within the central volume (18).

12 Claims, 2 Drawing Sheets

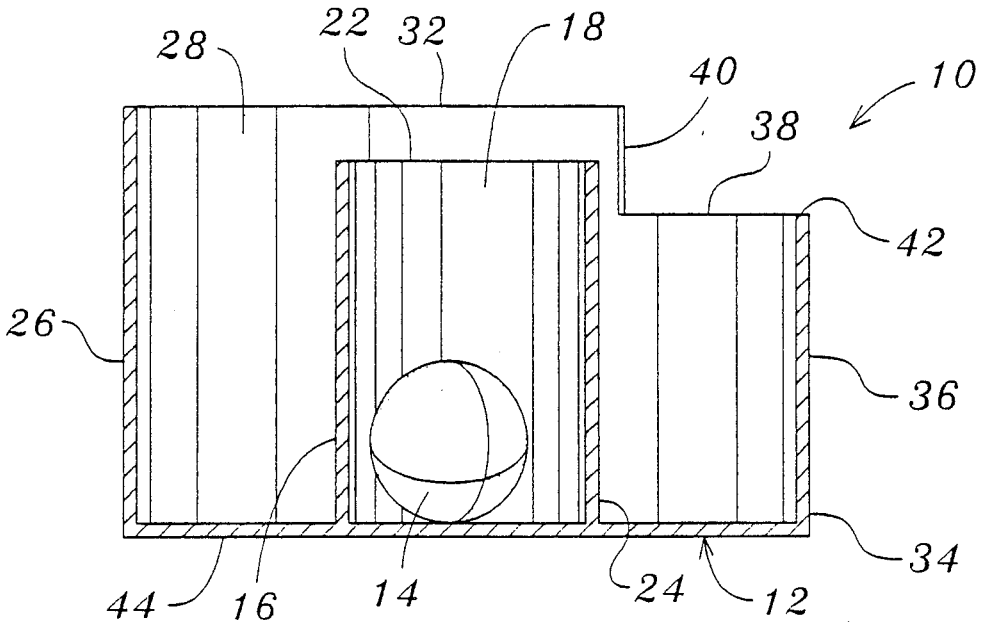
Fig. 2
Fig. 3
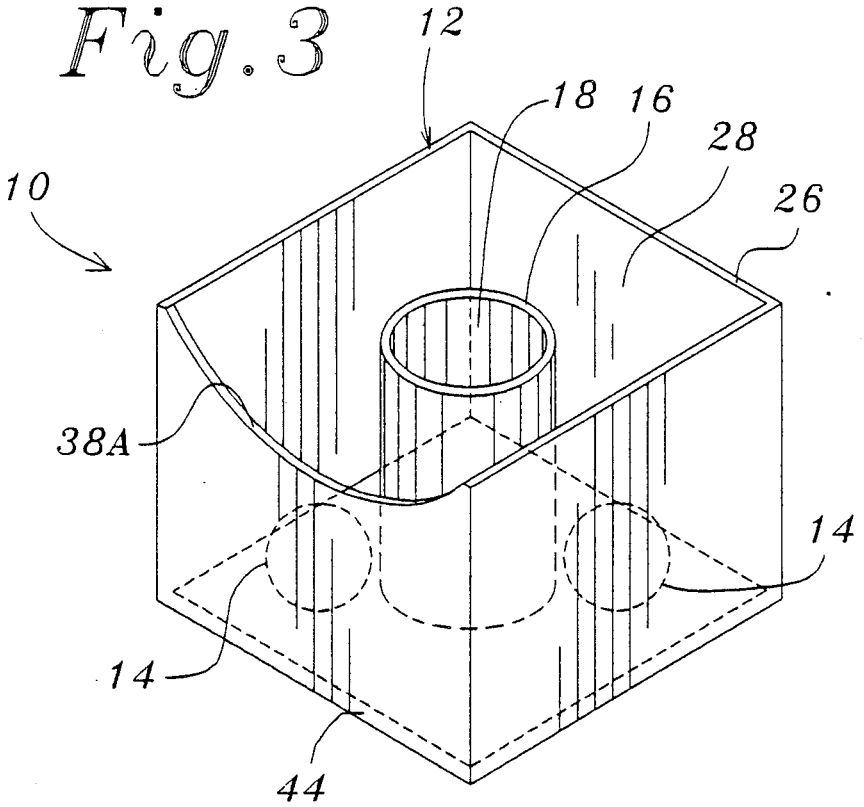

APPARATUS AND METHOD FOR PLAYING A GAME OF TOSS

DESCRIPTION

1. Technical Field

This invention relates to a game of toss. More specifically, it relates to an apparatus and method for playing a game of toss which may be played indoors and outdoors, by all ages, and by people with limited physical ability.

2. Background Art

Tossing games have been popular for many years. However, most tossing games are not suitable for both indoor and outdoor play. For those games which are compatible with either setting, most are not suitable competition for a wide variety of ages. Typically the indoor tossing games are only appealing to the younger children. Other games such as horseshoes are only suitable for those at least as old as the older children. Also, games such as horseshoes are dangerous for the players and spectators if a tossed object is errant. Players with limited physical ability are not capable of playing the tossing games with heavier objects.

Other tossing games have been developed for the entertainment of the user. Typical of the art are those disclosed in U.S. Pat. Nos. 1,114,523 issued to A. H. Revell on Oct. 20, 1914; 2,126,245 issued to W. A. Darby on Aug. 9, 1938; 3,244,420 issued to D. B. Poynter on Apr. 5, 1966; 3,790,174 issued to J. A. Skillern on Feb. 5, 1974; 3,924,856 issued to H. L, Dekan, et al., on Dec. 9, 1975; 4,186,925 issued to A. E. Goldfarb, et al., on Feb. 5, 1980; 4,204,682 issued to F. E. Brown on May 27, 1980; 4,335,881 issued to N. R. Warehime on Jun. 22, 1982; 4,726,591 issued to C. R. Johnson on Feb. 23, 1988; 4,938,485 issued to M. R. Hockridge, et al., on Jul. 3, 1990; and 4,943,065 issued to D. J. DeLapa on Jul. 24, 1990. However, none of these games is designed to be used indoors and outdoors, and by people of all ages and physical abilities while being easily disassembled for transport and storage.

Therefore, it is an object of this invention to provide a means for playing a game of toss indoors and outdoors.

It is also an object of this invention to provide a means for playing a game of toss by people of all ages and physical abilities.

Another object of this invention is to provide a game of toss with an apparatus that may be quickly and easily disassembled for transport and storage.

Still another object of this invention is to provide a game of toss with objects for tossing, such as balls or bean bags, which are pliable and lightweight such that when they are errantly tossed, there is little chance of harming another player or spectator.

Yet another object of the present invention is to provide tossing objects which are clearly distinguishable from each other such that scoring is simplified.

DISCLOSURE OF THE INVENTION

Other objects and advantages will be accomplished by the present invention which provides an apparatus for playing a game of toss. The game may be played by people of all ages and physical abilities, and may be played from a sitting or standing position. The game is adaptable for indoor and outdoor play. The apparatus for a game of toss includes a plurality of tossing objects such as bean bags or balls for tossing toward a target receptacle. The target receptacle includes at least an inner and an outer vertical receptacle with side walls such that a volume is defined within the inner wall and between the inner wall and the outer wall. The inner and outer wall have horizontal cross-sectional configurations defining selected geometrical shapes. In the preferred embodiment, the outer wall includes a forward portion with a depending section proximate the top such that a larger opening for the passage of the tossing object is provided. The inner and outer walls are attached to a base such that the walls do not move in relation to one another during play. The target receptacle of the preferred embodiment may be easily disassembled for transport and storage.

BRIEF DESCRIPTION OF THE DRAWINGS

The above mentioned features of the invention will become more clearly understood from the following detailed description of the invention read together with the drawings in which:

FIG. 2 is a cross-sectional view of the target receptacle taken at 2—2 of FIG. 1.

FIG. 3 is a perspective view of an alternate configuration of the target receptacle of the present invention.

BEST MODE FOR CARRYING OUT THE INVENTION

Figure 1:
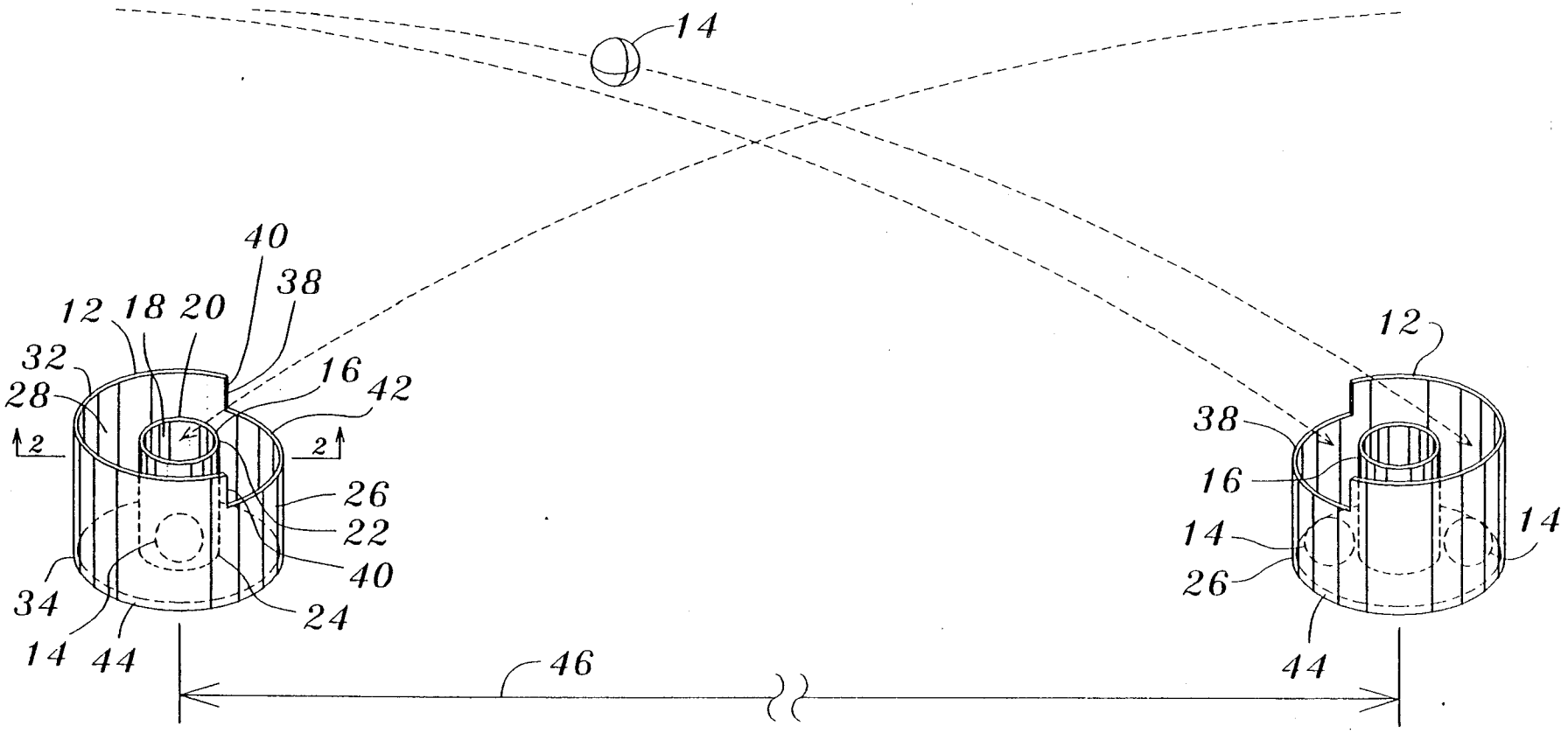
FIG. 1 is a perspective view of the apparatus for a game of toss constructed in accordance with several features of the present invention showing a pair of spaced apart target receptacles with cylindrical configurations, and also showing a plurality of tossing objects resting in various positions therewithin.

An apparatus for playing a game of toss incorporating various features of the present invention is illustrated generally at 10 in the figures. The apparatus for playing a game of toss 10 is designed for play by persons of all ages and physical abilities. Moreover, in the preferred embodiment the game 10 is designed to be played indoors and outdoors in either a standing or sitting position.

A target receptacle 12 is provided to receive tossed objects 14 by players in the course of a game. The target receptacle 12 includes at least one substantially vertical wall 16 which defines a volume 18 within which a tossed object 14 may be received. In the preferred embodiment, two vertical walls 16–26 are provided such that first and second volumes 18–28 are defined for a variation in scores.

A first volume 18 is defined by an inner wall 16 with a cylindrical configuration having a circular cross-section. The configuration of the inner wall 16 may be varied as desired. A second volume 28 is defined between the outer wall 26 and the inner wall 16. The horizontal cross-section of the outer wall 26 is of a selected geometrical configuration. FIG. 1 shows an outer wall 26 with a circular cross-section, with the inner wall 16 being concentric thereto. FIG. 3 shows an outer wall 26 with a rectangular horizontal cross-section, section, with the inner wall 16 disposed in the center thereof. It will be noted that any other desired configuration may be used, with the inner wall 16 disposed at any location within the outer wall 26. The vertical walls 16–26 of the preferred embodiment are fabricated from a durable, semi-rigid material.

The height of the inner wall 16 may be varied from the height of the outer wall 26. Raising the height of the inner wall 16 with respect to the outer wall 26 raises the difficulty of play. In the preferred embodiment, the height of the inner wall 16 is lower than the height of the outer wall 26 and higher then the bottom edge 42 of the forward depending section 38. The relationship of the elevations of the top edge 22 of the inner wall 16, the top edge 32 of the outer wall 26, and the bottom edge 42 of the depending section 38 are variable as desired.

Although not shown in the figures, it is foreseeable that three or more walls may be employed such that a greater number of receiving volumes are defined, and thus a greater variety of scoring possibilities.

A depending section 38 is defined proximate the upper end 32 of the forward portion 36 of the outer wall 26. The depending section 38 provides a greater entry area for tossed objects 14. In the embodiment shown in FIGS. 1 and 2, the depending section 38 has sides 40 which are parallel to each other and to the axis of the outer wall 26, the bottom 42 of the depending section 3s being defined by a straight edge connecting the ends of the sides 40 about the radius of the wall 26. The embodiment shown in FIG. 3 shows an arcically depending section 38A. Any combination of these or other similar types of depending sections may also be used.

A base portion 44 is provided to selectively fix the position of the outer wall 26 with respect to the inner wall 16. In the preferred embodiment, the base 44 may be removed from the inner and outer walls 16–26 as desired such that the apparatus 10 may be easily moved or stored. The inner wall 16 and outer wall 26 are each releasably attached to the base 44 proximate a substantial portion of the respective bottom ends 24–34. In the preferred embodiment, the configuration of the base 44 is substantially similar to the horizontal cross-section of the outer wall 26.

A plurality of tossing objects 14 are provided for tossing at the target receptacle 12. The tossing objects 14 may be bean bags, rubber or foam balls, or any other type of object which is lightweight and which has a pliable covering. In the preferred embodiment, the tossing objects 14 are particulate balls covered with a pliable material such as leather, such that the balls retain a substantially spherical configuration when thrown.

The balls 14 of the preferred embodiment are distinguishable from one another to aid in scoring. The identification of each ball 14 may be a number or letter printed thereon, or a variety of colors may be used. Other means of identification may also be used as desired.

The game of the present invention may be played by one or more persons, the number of persons being unlimited. The players may desire to play individually or on teams of two or more. The players will determine a distance from which to toss the objects 14, and will typically space two target receptacles 12 at the tossing distance, as denoted by arrow 46 in FIG. 1, with the players tossing the balls 14 from behind the appropriate target receptacle. The players will also determine a final score which, when reached, will determine the winner. The individuals or teams will then select the color/-number/letter that they desire to be for the game, and the game proceeds. Players begin tossing the balls 14 toward the target receptacle 12, attempting to land the balls 14 within the inner volume 18. When playing with opponents, the individuals or teams will alternate turns throwing the balls 14. The players continue tossing the balls 14 until they have all been thrown.

After all of the balls 14 have been tossed, score is taken and added to the previous score from all previous rounds. This is continued until a player or team reaches the predetermined score. If more than one individuals or teams are playing, play may continue to determine second and subsequent places.

Scoring is determined by the amount of balls 14 which have landed in the separate volumes 18–28, with a different amount of points being awarded for the different volumes 18–28. One method of scoring awards a higher number of points for each ball 14 landing with in the inner volume 18. Another method awards points in the second volume 28 only for the ball 14 resting closest to the inner wall 16. For this method, the distance from the inner wall 16 to each of the balls 14 in the second volume 28 must be measured, then the furthermost balls 14 removed or neglected. For this method, if two balls 14 are equally spaced from the inner wall 16, as when each is touching the inner wall 16, each ball 14 may be awarded equal points. Many other scoring methods may be used as desired and agreed upon by the players.

From the foregoing description, it will be recognized by those skilled in the art that an apparatus for playing a game of toss offering advantages over the prior art has been provided. Specifically, the apparatus provides a means for playing a game of toss by persons of all ages and physical capabilities. The game may be played indoors and outdoors. Further, the game may be played by a person standing or sitting, such that wheelchair patients may play.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. Apparatus for playing a game of toss, said apparatus comprising:

a plurality of tossing objects for tossing a selected distance toward a target;

at least one target receptacle for the collection of said tossing objects, said target receptacle including at least an inner substantially vertical receptacle with a first selected height and a horizontal cross-section defining a selected geometrical shape and an opening proximate the top end, and an outer substantially vertical receptacle with a second selected height and a horizontal cross-section defining a selected geometrical shape and an opening proximate the top end, said outer substantially vertical receptacle defining a second selected height at least as tall as said inner substantially vertical receptacle first selected height, said outer substantially vertical receptacle including a forward portion defining a depending section, said depending section depending to a third selected height, said third selected height being no greater than said first selected height of said inner substantially vertical receptacle; and a base means for securing said inner and outer substantially vertical receptacles during play to prevent movement of said receptacles with respect to each other, said base means defining a continuous substantially planar member and being disposed substantially horizontally to allow said tossing objects to rest at any location along the surface of said base means at which said tossing object lands after being tossed.

2. The apparatus for playing a game of toss of claim 1 wherein said tossing objects are fabricated from a pliable material and are filled with particulate material in order that said tossing objects maintain a substantial spherical shape.

3. The apparatus for playing a game of toss of claim 1 wherein said inner and outer substantially vertical receptacles are fabricated from a semi-rigid material.

4. The apparatus for playing a game of toss of claim 1 wherein said inner substantially vertical receptacle first selected height is substantially equal to said outer substantially vertical receptacle second selected height.

5. The apparatus for playing a game of toss of claim 1 wherein said inner substantially vertical receptacle first selected height is shorter than said outer substantially vertical receptacle second selected height a selected amount.

6. Apparatus for playing a game of toss, said apparatus comprising:

a plurality of tossing objects for tossing a selected distance toward a target, said tossing objects being fabricated from a pliable material and filled with particulate material in order that said tossing objects maintain a substantial spherical shape;

at least one target receptacle for the collection of said tossing objects, said target receptacle including at least an inner substantially vertical receptacle with a first selected height and a horizontal cross-section defining a selected geometrical shape and an opening proximate the top end, and an outer substantially vertical receptacle with a second selected height and a horizontal cross-section defining a selected geometrical shape and an opening proximate the top end, said outer substantially vertical receptacle defining a second selected height at least as tall as said inner substantially vertical receptacle first selected height, and wherein said outer substantially vertical receptacle includes a forward portion defining a depending section, said depending section depending to a third selected height, said first selected height of said inner substantially vertical receptacle being at least as tall as said third selected height, and said inner and outer substantially vertical receptacles being fabricated from a semi-rigid material; and a base means for securing said inner and outer substantially vertical receptacles during play to prevent movement of said receptacles with respect to each other, said base means defining a continuous substantially planar member and being disposed substantially horizontally to allow said tossing objects to rest at any location along the surface of said base means at which said tossing object lands after being tossed.

7. The apparatus for playing a game of toss of claim 6 wherein said inner substantially vertical receptacle first selected height is shorter than said outer substantially vertical receptacle second selected height a selected amount.

8. The apparatus for playing a game of toss of claim 6 wherein said tossing objects include a means for identifying each of said tossing objects after being tossed.

9. The apparatus for playing a game of toss of claim 6 wherein each of said target receptacles may be selectively disassembled for transport or storage.

10. The apparatus for playing a game of toss of claim 6 wherein said inner substantially vertical receptacle first selected height is substantially equal to said outer substantially vertical receptacle second selected height.

11. A method of playing and scoring a game of toss using at least one target receptacle and a plurality of tossing objects, each target receptacle including at least two substantially vertical receptacles, one of said receptacles being dimensioned and positioned such as to circumvent at least one other of said receptacles such that an annular opening is defined therebetween, said outer receptacle defining a height at least equal to the height defined by each of said inner receptacles, and each of said receptacles defining substantially horizontal openings, said outer receptacle further defining a depending section on the forward portion, said inner receptacle further defining a height at least equal to the height defined by the lowermost portion of said depending section, said method including:

a) selecting teams for competition;

b) choosing an order of play by any of a variety of methods;

c) selecting a distance from which to toss said tossing objects toward said target receptacle;

d) tossing said objects toward said target receptacle;

e) scoring a first selected amount of points for every tossing object received by inner of said substantially vertical receptacles;

f) scoring a second selected amount of points for every tossing object received by said annular opening defined between said outer and inner substantially vertical receptacles;

g) adding said points scored from tossing objects received by each of said substantially vertical receptacles to total score from previous rounds; and h) repeating steps d) through g) until a selected score is reached.

12. A method of playing and scoring a game of toss of claim 11 wherein step f) includes the steps of:

a) measuring the distance from said inner vertical receptacle to each of said tossing objects received by said annular opening defined between said outer and inner substantially vertical receptacles; and b) scoring a selected number of points for said tossing objects within said vertical receptacle which are nearest to said inner vertical receptacle.

* * * * *